US005988095A

United States Patent [19]

Kallenberger

[11] Patent Number: 5,988,095

[45] Date of Patent: Nov. 23, 1999

[54] CLAMPING MECHANISM FOR SECURING A ROPE TO A WINCH DRUM

[75] Inventor: Harvey J. Kallenberger, Wind Lake, Wis.

[73] Assignee: Harnischfeger Technologies, Inc., Wilmington, Del.

[21] Appl. No.: 09/064,534

[22] Filed: Apr. 22, 1998

[51] Int. Cl.[6] ..... B63B 21/00

[52] U.S. Cl. ..... 114/230.23; 24/122.6; 24/135 K

[58] Field of Search ..... 403/306, 312; 24/122.6, 135 K; 114/230.1, 230.2, 230.23

[56] References Cited

U.S. PATENT DOCUMENTS

| | | | |
|---|---|---|---|
| 3,395,668 | 8/1968 | George | 114/230.2 |
| 3,851,613 | 12/1974 | Armour | 114/230.23 |
| 4,446,807 | 5/1984 | Johnson et al. | 114/230.23 |
| 5,215,463 | 6/1993 | Crook | 24/135 K |
| 5,427,469 | 6/1995 | Galarnyk | 24/122.6 |

*Primary Examiner*—Stephen Avila

*Attorney, Agent, or Firm*—James Earl Lowe, Jr.

[57] ABSTRACT

A rope clamp for clamping a rope to a winch drum surface comprises first and second bolts, each of which has a head and a threaded end, an upper clamp having two opposed ends and a first hole receiving the first bolt near the one end thereof and a second hole receiving the second bolt near the other end thereof. The clamp further includes a lower clamp having two opposed ends and a first indentation open from the one end thereof and receiving the first bolt, and a second indentation open from the other end thereof and receiving the second bolt. The lower clamp further has a bottom adapted to be secured to the surface and having first and second bolt head receiving slots, each of which is wider than its respective one of the first and second indentations, the first and second slots each being open at its respective lower clamp end and receiving a respective bolt head and preventing the respective bolt head from rotating. The clamp further includes two bolt retainer plates, each of which is releasably secured to a respective one of the lower clamp ends over the respective one of the first and second indentations so that the bolts are held in the first and second indentations. The clamp further includes two nuts, each of which is on a respective one of the threaded ends of the bolts.

22 Claims, 2 Drawing Sheets

CLAMPING MECHANISM FOR SECURING A ROPE TO A WINCH DRUM

BACKGROUND OF THE INVENTION

The present invention relates to rope clamps, and, more specifically, to a clamping mechanism for securing an end of a rope to a winch drum or to a dead end.

Winches typically have a power driven, rotatable winch drum to which one end of a rope, usually fabricated out of wire, is secured. The other or free end of the wire rope is secured to the load that is to be moved or lifted. Such winches are frequently used to move extremely heavy loads which may exceed 70 tons and it is very difficult to securely attach the rope end to the winch drum in a manner that will prevent its slipping free when subjected to high tension forces caused by such heavy loads.

SUMMARY OF THE INVENTION

A need exists for an improved clamping mechanism which does not require a high degree of installation skill, and which can permit the disassembly and reassembly of the clamping mechanism, including the replacement of any damaged parts, quickly and without substantial difficulty.

The invention provides an improved clamping mechanism for securing a rope end to a winch drum. More specifically, the invention provides a rope clamp for clamping a rope to a surface. The rope clamp comprises first and second bolts, each of which has a head and a threaded end, an upper clamp having two opposed ends and a first hole receiving the first bolt near the one end thereof and a second hole receiving the second bolt near the other end thereof. The clamp further includes a lower clamp having two opposed ends and a first indentation open from the one end thereof and receiving the first bolt, and a second indentation open from the other end thereof and receiving the second bolt. The lower clamp further has a bottom adapted to be secured to the surface and having first and second bolt head receiving slots, each of which is wider than its respective one of the first and second indentations, the first and second slots each being open at its respective lower clamp end and receiving a respective bolt head and preventing the respective bolt head from rotating. The clamp further includes two bolt retainer plates, each of which is releasably secured to a respective one of the lower clamp ends over the respective one of the first and second indentations so that the bolts are held in the first and second indentations. The clamp further includes two nuts, each of which is on a respective one of the threaded ends of the bolts.

Figure 1:
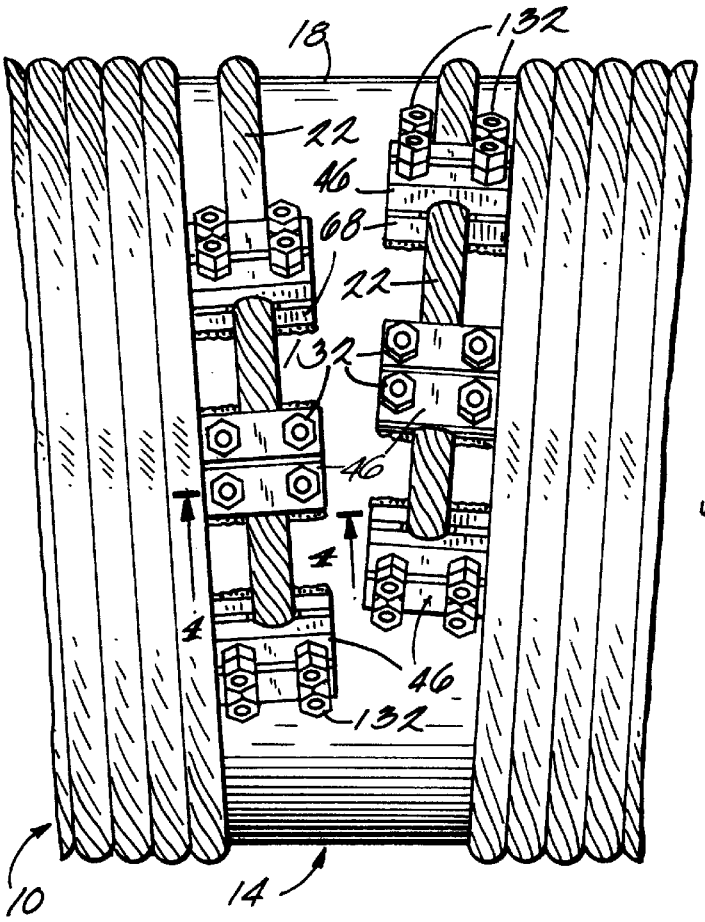
FIG. 1 is a top view of a winch in which the clamping mechanism of the invention is incorporated.
Figure 4:
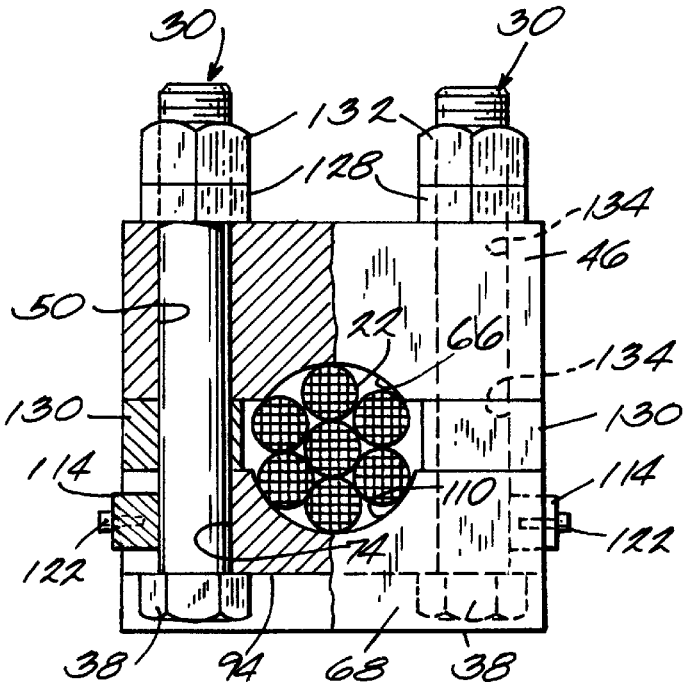
FIG. 4 is a section taken along lines 4—4 of FIG. 1.
Figure 2:
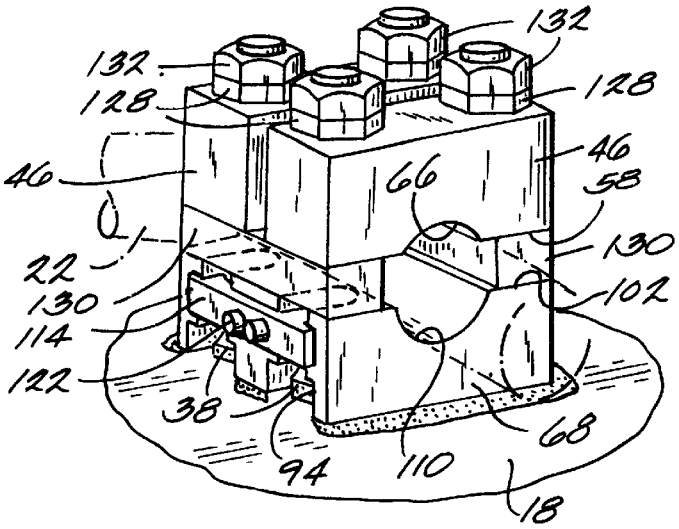
FIG. 2 is an enlarged partial view of the winch, showing the preferred embodiment of the clamping mechanism.
Figure 3:
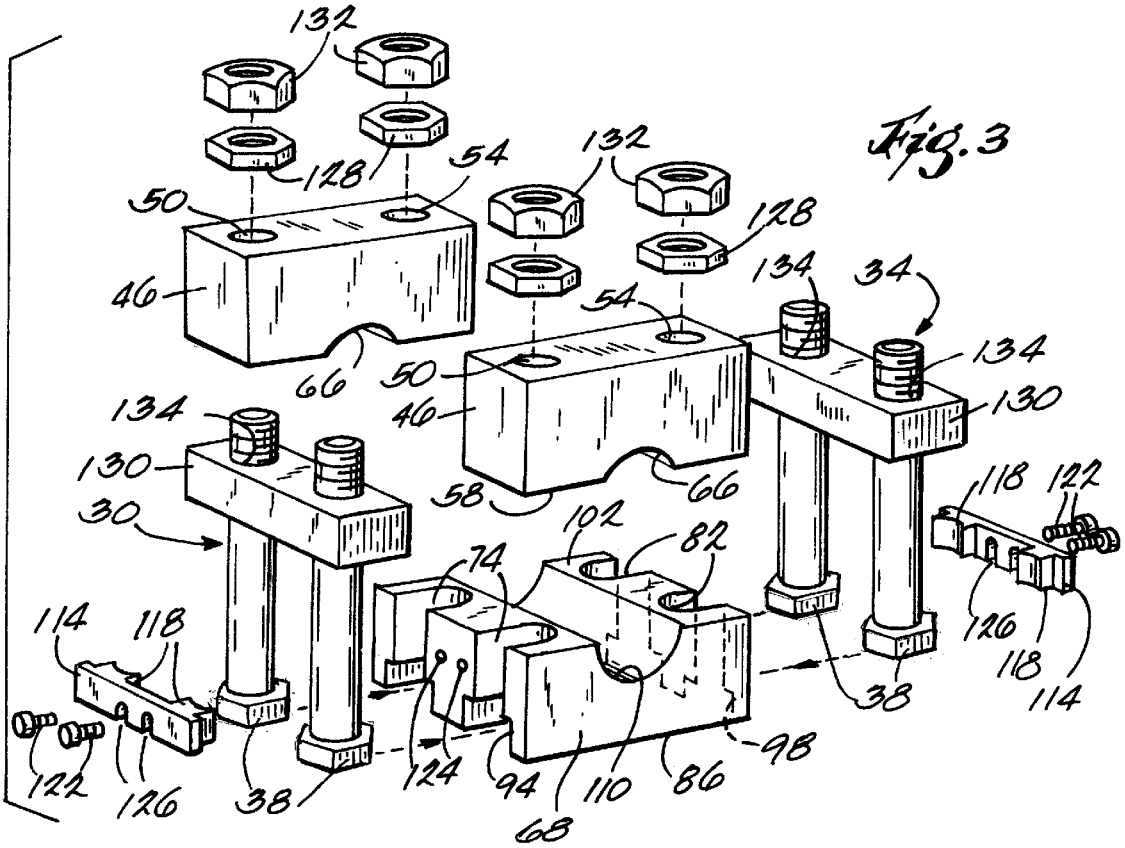
FIG. 3 is an exploded perspective view of the rope clamp of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENTS

As illustrated in the drawings, the invention comprises a winch 10 having a drum 14 with a drum mounting surface 18, a rope 22, and a plurality of rope clamps 26 for clamping ropes to the mounting surface 18. More particularly, each of the rope clamps 26 comprise a plurality of first bolts 30 and a plurality of second bolts 34, each of which has a head 38 and a threaded end 42. In the illustrated embodiment, two first bolts 30 and two second bolts 34 are used. In other embodiments, one first bolt 30 and one second bolt 34 can be used. In still other embodiments, more than two first bolts 30 and more than two second bolts 34 can be used, especially when the rope clamp 26 is used to hold large wire rope 22, which can be more than six inches in diameter. In still another less preferred embodiment, only one first or second bolt can be used.

The rope clamp 26 further includes a plurality of upper clamps 46, each of which has two opposed ends and a first hole 50 receiving one of said plurality of first bolts 30 near the one end thereof and a second hole 54 receiving one of said plurality of second bolts 34 near the other end thereof. In the preferred embodiment, each of said upper clamps 46 has a bottom 58 with an arcuate opening 66 adapted to receive the rope 22, although in other embodiments, such an opening would not be necessary. In the illustrated embodiment, two upper clamps 46 are used. In other embodiments, one upper clamp 46 can be used. In still other embodiments, more than two upper clamps 46 can be used, especially when the rope clamp 46 is used to hold large wire rope 22, which can be more than six inches in diameter. In still other embodiments, a single upper clamp 46 including a plurality of spaced apart first holes and a plurality of spaced apart second holes can be used, instead of a plurality of upper clamps 46.

The rope clamp 26 further includes a lower clamp 68 which has two opposed ends and a plurality of first spaced apart indentations 74 open from one end thereof and receiving one each of said plurality of first bolts 30, and a plurality of second spaced apart indentations 82 open from the other end thereof and receiving one each of said plurality of second bolts 34. In the illustrated embodiment, two first bolt indentations 74 and two second bolt indentations 82 are used. In other embodiments, one first bolt indentation 74 and one second bolt indentation 82 can be used. In still other embodiments, more than two first bolt indentations 74 and more than two second bolt indentations 82 can be used, especially when the rope clamp, is used to hold large wire rope, which can be more than six inches in diameter.

The lower clamp 68 further has a bottom 86 conforming to the drum surface 18 and secured to the drum surface 18 and having a plurality of first bolt head receiving slots 94 and a plurality of second bolt head receiving slots 98, each of which is wider than its respective one of said first and second plurality of indentations 74 and 82, respectively, said first and second plurality of slots 94 and 98, respectively, each being open at its respective lower clamp end and receiving a respective bolt head 38 and preventing said respective bolt head 38 from rotating. More specifically, the walls of the slots engage the heads of the bolts and prevent the bolt heads from rotating. The shoulder formed between the bolt head receiving slots and their respective indentations hold the bolt heads in the lower clamp. In the illustrated embodiment, the first bolt slot 94 and the second bolt slot 98 are formed from a single slot cut into the bottom wall of the lower clamp 68. In other embodiments, the first and second bolts 94 and 98, respectively, could be separate slots cut into the lower clamp ends, and also not open to the lower clamp bottom wall. In the preferred embodiment, the bottom 86 is arc welded to the mounting surface 18.

In the illustrated embodiment, two first bolt slots 94 and two second bolts slots 98 are used. In other embodiments, one first bolt slot 94 and one second bolt slot 98 can be used. In still other embodiments, more than two first bolt slots 94 and more than two second bolt slots 98 can be used, especially when the rope clamp is used to hold large wire rope 22, which can be more than six inches in diameter. In the preferred embodiment, the lower clamp 68 has a top 102 with an arcuate opening 110 adapted to receive the rope 22, although in other embodiments, such an opening would not be necessary. In the preferred embodiment, the lower clamp arcuate opening 110 is deeper than the upper clamp arcuate openings 66 in order to permit easier holding of the wire rope 22 in the clamp 26. In other embodiments (not shown), the upper clamp opening 66 or the lower clamp opening 110 or both can have a roughed surface or projections to further aid in holding the rope 22 within the clamp 26.

The rope clamp 26 further includes a plurality of bolt retainer plates 114, each of which is releasably secured to a respective one of said lower clamp ends over the respective ones of said first and second indentations 74 and 82, respectively, so that said bolts are held in said first and second indentations. In the illustrated embodiment, each retainer plate 114 covers all of the indentations on one end of the lower clamp 68. In other embodiments, a plurality of retainer plates 114 could be used on each end of the lower clamp. In the preferred embodiment, each of the retainer plates 114 has an extension 118 which extends into its respective lower clamp indentation. The extension 118 positions the respective bolt in its respective indentation so that the bolt is aligned with its respective opening in its respective upper clamp.

In the preferred embodiment, each of the retainer plates 114 is releasably secured to the lower clamp 68 by a pair of cap screws 122 received in threaded openings 124 in the lower clamp 68. The retainer plate 114 has two spaced apart downwardly open slots 126, each of which receive a respective one of the cap screws 122. The slots 126 permit starting the cap screws 122, and then placing the retainer plate 114 over the screws 122, before finishing the tightening of the cap screws 122.

The rope clamp 26 further includes two nuts 132, each of which is on a respective one of the threaded ends 42 of said bolts. Although not required, in the preferred embodiment, two jam nuts 128 are also threaded onto the ends 42 of the bolts so as to discourage the nuts 132 from coming loose. In the preferred embodiment, the rope clamp 26 further includes two shims 130, each is which has a plurality of holes 134, each of which receives one of the bolts, the shims 130 being positioned between the upper clamps 46 and the lower clamp 68. In other embodiments, the shims 130 need not be used.

The rope 22 is secured to the winch drum 14 using the following procedure. Without the retainer plates 114 being in place, the bolts are placed in the indentations. The retainer plates 114 are then secured to the lower clamp 68 over the indentations so that the bolts can not leave the indentations. The wire rope 22 is then placed in the arcuate opening 110 on the top 102 of the lower clamp 68. The shims 130 are then placed over the bolts, and the upper clamps 46 are then placed on the bolts. The nuts 132 and jam nuts 128 are then threaded on the ends 42 of the bolts. The depth of the shims 130 is such that when the wire rope is placed between the upper and lower clamps, a sufficient amount of space is still present between the shims 130 and the upper and lower clamps to permit proper tightening down of the clamps against the wire rope, while at the same time preventing too much compression of and damage of the rope 22. In the event a bolt becomes damaged or if it is necessary to change the rope 22, the nuts 132 and jam nuts 128 can be removed, the upper and lower clamps disassembled, the cap screws 122 loosened, the retainer plate 114 removed, the bolts replaced, and the wire rope and the clamp 26 reassembled.

In the preferred embodiment, a plurality of aligned and spaced apart rope clamps 26 are used, each of which clamps a portion of the rope. Further, when two winch ropes are used, two sets of aligned and spaced apart rope clamps 26 can be used. In other embodiments, the mounting surface 18 can be a drum flange (not shown), or any other mounting surface. The invention can also be used to secure a rope at any rope midpoint or rope termination, such as at the rope dead end of an overhead crane.

I claim:

1. A rope clamp for clamping a rope to a mounting surface, the rope clamp comprising first and second bolts, each of which has a head and a threaded end, an upper clamp having two opposed ends and a first hole receiving said first bolt near the one end thereof and a second hole receiving said second bolt near the other end thereof, a lower clamp having two opposed ends and a first indentation open from the one end thereof and receiving said first bolt, and a second indentation open from the other end thereof and receiving said second bolt, said lower clamp further having a bottom adapted to be secured to the surface and having first and second bolt head receiving slots, each of which is wider than its respective one of said first and second indentations, said first and second slots each being open at its respective lower clamp end and receiving a respective bolt head and preventing said respective bolt head from rotating, two bolt retainer plates, each of which is releasably secured to a respective one of said lower clamp ends over the respective one of said first and second indentations so that said bolts are held in said first and second indentations, and two nuts, each of which is on a respective one of the threaded ends of said bolts.

2. A rope clamp in accordance with claim 1 wherein the rope is clamped between said lower clamp and said upper clamp and between said first bolt and said second bolt.

3. A rope clamp in accordance with claim 2 wherein said upper clamp has a bottom with an arcuate opening adapted to receive the rope.

4. A rope clamp in accordance with claim 3 wherein the wherein said lower clamp has a top with an arcuate opening adapted to receive the rope.

5. A rope clamp in accordance with claim 4 wherein said lower clamp arcuate opening is deeper than said upper clamp arcuate opening.

6. A rope clamp in accordance with claim 2 wherein the wherein said lower clamp has a top with an arcuate opening adapted to receive the rope.

7. A rope clamp in accordance with claim 2 wherein said clamp further includes two shims, each is which has a hole receiving one of said bolts, said shims being positioned between the upper clamp and the lower clamp.

8. A rope clamp in accordance with claim 1 wherein the surface is curved and said lower clamp bottom is also curved in order to conform to the surface.

9. A rope clamp in accordance with claim 1 wherein each of said retainer plates has a slot, and each of said retainer plates is releasably secured to said lower clamp by a cap screw received in a threaded opening in the lower clamp and received in said retainer plate slot, so that said retainer plate can be removed from said lower clamp without complete removal of said cap screw.

10. A rope clamp in accordance with claim 1 wherein each of said retainer plates has an extension which positions its respective bolt in its respective indentation so that said bolt is aligned with its respective opening in said upper clamp.

11. A rope clamp in accordance with claim 1 wherein said first and said second bolt head receiving slots are formed from a single slot.

12. A rope clamp for clamping a rope to a mounting surface, the rope clamp comprising a plurality of first bolts and a plurality of second bolts, each of which has a head and a threaded end, a plurality of upper clamps, each of which has two opposed ends and a first hole receiving one of said plurality of first bolts near the one end thereof and a second hole receiving one of said plurality of second bolts near the other end thereof, a lower clamp having two opposed ends and a plurality of first spaced apart indentations open from the one end thereof and receiving one each of said plurality of first bolts, and a plurality of second spaced apart indentations open from the other end thereof and receiving one each of said plurality of second bolts, said lower clamp further having a bottom adapted to be secured to the surface and having a plurality of first bolt head receiving slots and a plurality of second bolt head receiving slots, each of which is wider than its respective one of said first and second plurality of indentations, said first and second plurality of slots each being open at its respective lower clamp end and receiving a respective bolt head and preventing said respective bolt head from rotating, a plurality of bolt retainer plates, each of which is releasably secured to a respective one of said lower clamp ends over the respective one of said first and second indentations so that said bolts are held in said first and second indentations, and two nuts, each of which is on a respective one of the threaded ends of said bolts.

13. A winch having a drum with a drum surface, a rope, and a rope clamp for clamping the rope to the drum surface, the rope clamp comprising a plurality of first bolts and a plurality of second bolts, each of which has a head and a threaded end, a plurality of upper clamps, each of which has two opposed ends and a first hole receiving one of said plurality of first bolts near the one end thereof and a second hole receiving one of said plurality of second bolts near the other end thereof, a lower clamp having two opposed ends and a plurality of first spaced apart indentations open from the one end thereof and receiving one each of said plurality of first bolts, and a plurality of second spaced apart indentations open from the other end thereof and receiving one each of said plurality of second bolts, said lower clamp further having a bottom conforming to the drum surface and secured to the drum surface and having a plurality of first bolt head receiving slots and a plurality of second bolt head receiving slots, each of which is wider than its respective one of said first and second plurality of indentations, said first and second plurality of slots each being open at its respective lower clamp end and receiving a respective bolt head and preventing said respective bolt head from rotating, a plurality of bolt retainer plates, each of which is releasably secured to a respective one of said lower clamp ends over the respective one of said first and second indentations so that said bolts are held in said first and second indentations, and two nuts, each of which is on a respective one of the threaded ends of said bolts.

14. A rope clamp in accordance with claim 13 wherein the rope is clamped between said lower clamp and said upper clamps and between said plurality of first bolts and said plurality of second bolts.

15. A winch in accordance with claim 14 wherein said winch has a plurality of aligned and spaced apart rope clamps, each of which clamps a portion of the rope.

16. A rope clamp in accordance with claim 14 wherein said each of said upper clamps has a bottom with an arcuate opening adapted to receive the rope.

17. A rope clamp in accordance with claim 16 wherein the wherein said lower clamp has a top with an arcuate opening adapted to receive the rope.

18. A rope clamp in accordance with claim 17 wherein said lower clamp arcuate opening is deeper than said upper clamp arcuate openings.

19. A rope clamp in accordance with claim 14 wherein said clamp further includes two shims, each is which has a plurality of holes, each of which receives one of said bolts, said shims being positioned between the upper clamps and the lower clamp.

20. A rope clamp in accordance with claim 13 wherein each of said retainer plates has a slot, and each of said retainer plates is releasably secured to said lower clamp by a cap screw received in a threaded opening in the lower clamp and received in said retainer plate slot, so that said retainer plate can be removed from said lower clamp without complete removal of said cap screw.

21. A rope clamp in accordance with claim 20 wherein each of said retainer plates has an extension which positions its respective bolt in its respective indentation so that said bolt is aligned with its respective opening in said upper clamp.

22. A rope clamp for clamping a rope to a mounting surface, the rope clamp comprising a bolt having a head and a threaded end, an upper clamp having two opposed ends and a hole receiving said bolt near one end thereof, a lower clamp having two opposed ends and an indentation open from one end thereof and receiving said bolt, said lower clamp further having a bottom adapted to be secured to the mounting surface and having a bolt head receiving slot which is wider than said indentation, said slot being open at the lower clamp end having the indentation and receiving said bolt head and preventing said bolt head from rotating, a bolt retainer plate which is releasably secured to said lower clamp end over said indentation so that said bolt is held in said indentation, and a nut on a said threaded end of said bolt.

* * * * *